United States Patent [19]

Sommer

[11] Patent Number: 4,518,437

[45] Date of Patent: May 21, 1985

[54] METHOD AND APPARATUS FOR CLEANING A WATER TANK

[75] Inventor: Peter Sommer, Villnachern, Switzerland

[73] Assignee: Sommer, Schenk AG, Switzerland

[21] Appl. No.: 511,010

[22] Filed: Jul. 5, 1983

[30] Foreign Application Priority Data

Jul. 5, 1982 [CH] Switzerland ..... 4085/82

[51] Int. Cl.[3] ..... B08B 9/08; E04H 3/20

[52] U.S. Cl. ..... 134/18; 134/21; 134/22.1; 15/1.7; 15/319

[58] Field of Search ..... 15/1.7, 319; 134/18, 134/21, 22.1; 210/169, 242.1; 114/144 E; 56/10.2

[56] References Cited

U.S. PATENT DOCUMENTS

| | | | |
|---|---|---|---|
| 3,381,456 | 5/1968 | Taylor | 56/10.2 |
| 3,753,265 | 8/1973 | Wulc | 15/1.7 |
| 4,103,638 | 8/1978 | Fowler | 114/144 E |
| 4,154,680 | 5/1979 | Sommer | 210/169 |
| 4,304,022 | 12/1981 | Sommer | 15/1.7 |

FOREIGN PATENT DOCUMENTS

| | | | |
|---|---|---|---|
| 50157 | 4/1979 | Japan | 15/1.7 |

*Primary Examiner*—Richard V. Fisher
*Assistant Examiner*—W. Gary Jones
*Attorney, Agent, or Firm*—Roylance, Abrams, Berdo & Goodman

[57] ABSTRACT

A cleaning apparatus for a pool or tank has caterpillar tracks controlled by steering clutches actuated by a regulating device with a compass as a measured course value sensor, a setting device for the desired course value, a comparator for determining the error between the measured course value and the desired course value. The apparatus follows in oblique path from one travel path to the next by modifying the desired course by a given angle. After a given time, the desired course value is again modified by the same amount in the opposite direction, so that the cleaning apparatus returns parallel to the first path. By setting the angle and duration for the oblique travel, the new travel path can be selected independently of the dimensions of the pool to be cleaned.

7 Claims, 3 Drawing Figures

METHOD AND APPARATUS FOR CLEANING A WATER TANK

This invention relates to a submersible apparatus for cleaning a water tank, reservoir or the like and to a method for controlling the propelling means of the apparatus so that it follows a desired travel pattern.

BACKGROUND OF THE INVENTION

It is known to use cleaning devices for cleaning water tanks or reservoirs, and particularly swimming pools to clean the bottom and, optionally, the walls of the pool, the apparatus being operated from outside of the pool. It is possible, in principle, to continuously control such a cleaning apparatus so that it consecutively travels across the bottom of the pool in a sequence of paths such that it travels over the complete surface of the pool bottom and accomplishes total cleaning of the surface. It is known also to operate such cleaning apparatus in an automatic manner. For this purpose, one known cleaning device has sensing rods which cause reversal of the direction of travel upon contact with the pool wall or some other obstacle, simultaneously setting a new course of travel. The apparatus then moves on its new course until the next travel direction reversal or change takes place. A disadvantage of this apparatus is that there is no systematic traversing of the pool bottom. The apparatus merely travels backward and forward over the pool bottom and it is quite possible for certain areas to be traversed several times while other areas are not traversed at all.

In another known apparatus for automatic operation, the sensing rod or rods must be set at a predetermined angle as a function of the pool size so that, after covering a particular travel path, the return travel path is inclined with the direction of the first one and then the next travel in sequence is parallel with the first. Quite apart from the fact that the inclined path is not controlled and can, consequently, be influenced by unevennesses or the like, certain areas at the start and end of the travel path are traversed twice. This apparatus must be monitored to ensure complete cleaning of the pool bottom despite the automatic reversal and angular travel.

In another known apparatus, the performance of the individual, automatically performed partial operations during travel direction reversal and direction change are determined by a microprocessor, but the adherence to a course is not ensured in this apparatus and, consequently, the apparatus can be caused to stray from its course by obstacles.

BRIEF SUMMARY OF THE INVENTION

Accordingly, an object of the present invention is to provide a method of controlling a cleaning apparatus such that the entire bottom surface of a water tank such as a pool or reservoir is completely traveled over by the apparatus and therefore cleaned with a minimium travel path and in a systematic fashion.

Briefly described, the invention comprises a method of controlling an underwater cleaning apparatus for cleaning the interior of a water tank, the cleaning apparatus being of the type including a housing carrying cleaning means and reversible and steerable means for propelling the housing across a surface of the tank comprising the steps of establishing a sequence of courses defining a path of travel for the apparatus to follow to repeatedly traverse the surface such that all of the surface will be traversed and cleaned in a systematic fashion, providing a compass carried by the housing for producing a signal representative of the actual course being traveled by the cleaning apparatus, providing limit sensors carried by the housing to detect an obstacle in the path of the apparatus and cause reversal of its direction of travel, initially setting the apparatus on a first course, comparing the course with the compass signal and adjusting the steerable means to correct deviations, until a limit sensor causes reversal of the travel direction, and setting the apparatus on a second course at a predetermined angle relative to the first course and holding the second course for a first predetermined period of time.

In another aspect, the invention includes an underwater cleaning apparatus for traversing a surface of a tank or the like for cleaning the surface, the apparatus being of the type having a housing carrying cleaning means and reversible and steerable means for propelling the housing across the tank surface, the apparatus comprising compass means for producing a signal representative of the actual course being traveled by the apparatus; setting means for producing signals representative of desired courses to be followed; timer means operatively associated with said setting means for determining the lengths of time for each course; means for comparing the actual and desired course signals and for producing an error signal; said means for propelling including caterpillar track means for conveying the housing; a drive motor; clutch means for selectively coupling said drive motor to said track means; and control means responsive to said error signals for controlling said clutch means to thereby steer said apparatus along each course.

As will be seen, the disadvantages of the prior art are overcome by the method and apparatus of the present invention in which the course of the travel path is maintained by a regulating device which acts on the steerable propelling apparatus and, because of the reference or control input, a first course is set and a compass is used as a sensor for determining the actual course being followed. When the cleaning apparatus comes into contact with a wall or some other obstacle, there is a reversal of the direction of travel accompanied by the establishment of a second course, differing from the first by a predetermined angle, the second course being maintained for a preset first period of time.

The apparatus preferably includes traveling gear having a track-laying or caterpillar type of drive for a chassis which has a course regulator and which carries a compass as the actual travel sensor, the courses being established in a setting device. A comparator determines the error between the measured and desired course values and actuates a control member which operates a control clutch, altering the drive characteristics of the caterpillar tracks in conjunction with a timer. Manual opertating means can also be employed for purposes of setting the courses.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF PREFERRED EMBODIMENTS

Figure 1:
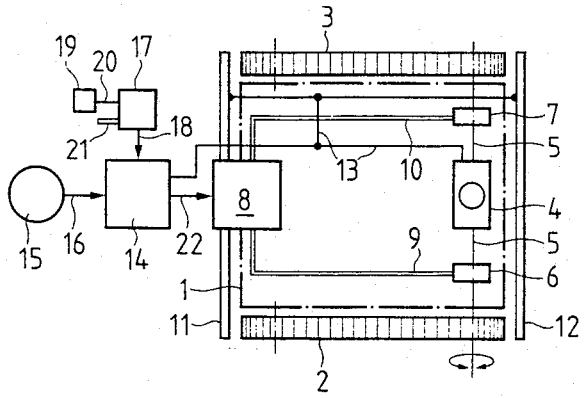
FIG. 1 is a simplified schematic plan view of an apparatus in accordance with the invention in conjunction with a schematic block diagram of the control devices associated therewith.

The cleaning apparatus schematically illustrated in FIG. 1 includes a housing 1 which is shown in dash-dot lines and which is supported and propelled on a drive apparatus such as a track-laying or caterpillar support including caterpillar tracks 2 and 3. The tracks are driven by a drive 4 which rotates drive shafts 5. The drive 4 can, for example, be a reversible electric motor coupled by a gear to the drive shafts.

For purposes of steering the propelling means, the drive shafts are not continuous but are coupled together by steering clutches 6 and 7 which can be, for example, electromagnetic clutches operated by an operating mechanism such as a control member 8 which is coupled to the clutches by linkages 9, 10. Cleaning devices of this type are described in detail in U.S. Pat. Nos. 4,304,022 and 4,154,680 and no further description of the prior art devices will be therefore be given.

The control apparatus with which the cleaning apparatus of FIG. 1 is equipped includes several components which are all carried by housing 1 although, in FIG. 1, several of these components are shown outside of the chassis for ease of illustration.

As will be understood from the foregoing discussion, the cleaning apparatus is intended to automatically travel across the entire bottom area of a swimming pool in a pattern including a series of juxtaposed travel paths while the travel direction changes and the transfer to an adjacent path take place automatically. However, it is important for all of the movements of the cleaning apparatus to be controlled. Thus, at the front and rear, the cleaning apparatus has sensing rods 11 and 12, respectively. Rods 11, 12 project beyond the housing 1 and are therefore the first part of the apparatus to come into contact with a pool wall of some other obstacle such as a ladder or the like. When the sensing rods encounter an obstacle of some kind, an electrical signal is produced which is connected by conductors 13 to a regulator 14 which produces a reversal signal to reverse the direction of drive 4, causing the drive to rotate in the opposite direction.

In order to provide the apparatus with means for determining the actual course being traveled by the apparatus, it is provided with a compass 15 which can be a magnetic or gyro compass and which produces a signal representative of the actual course value to regulator 14 through a conductor 16. Regulator 14 compares this value with a predetermined reference or control input which is established in a setting device 17, the desired path being supplied to comparator/regulator 14 on a conductor cable 18. A timer 19 is connected to setting device 17 by a cable 20 for assisting in the control function. In addition, setting device 17 has a manually operable means 21 for permitting the desired course value to be selected in the setting device 17. This manual input also permits the cleaning apparatus to be manually controlled if such operation is desired under special circumstances. Regulator 14 has a connection 22 to the steering control apparatus 8 by which the course correction and oblique travel signals can be transmitted.

Figure 2:
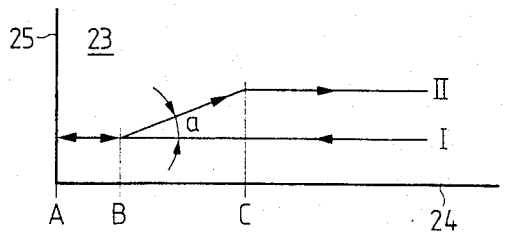
FIG. 2 is a partial plan view of a pool bottom showing travel paths to be traversed by the cleaning apparatus.

The function of the control apparatus of FIG. 1 can now be described in greater detail with reference to FIG. 2 which is a plan view of a portion of a swimming pool 23 having walls 24, 25. Lines I and II diagrammatically illustrate two adjacent travel paths which are to be successively traversed by the cleaning apparatus. The apparatus first performs its preselected course on path 1, this course being continuously monitored and regulated by regulator 14. When one of the sensors 11, 12 comes in contact with the pool wall 25, a signal is produced which reverses the direction of travel, as previously described. The cleaning apparatus then covers a distance A-B along the same course, this distance being defined by the measurement of a time preset by timer 19. This return travel over distance A-B on the same course serves to prevent the cleaning apparatus from becoming engaged with other obstacles, such as columns, ladders or gutters, which might occur upon the beginning of an oblique direction of travel.

Another reason for including this relatively short reversal along the initial path is to permit the cleaning apparatus to move away from the vicinity of the reinforcement of the pool wall 25 which can be ferromagnetic in nature and which may give rise to disturbances of the geomagnetic field which might affect the operation of the apparatus when using a magnetic compass as the actual course value sensor. Such possibilities are eliminated by maintaining the return path on the same course. At the end of this return path distance A-B, the setting device 17 is operated by timer 19 so that it produces a new desired course value which is modified by a predetermined angle a. Comparator/regulator 14 thus senses a difference in angle between the desired and actual courses and produces a signal which causes the steering mechanism to bring the cleaning apparatus to the direction given by the new desired course value, steering control 8 causing one of the clutches 6, 7 to be appropriately operated so that the apparatus assumes the oblique course at point B. For a time interval established by timer 19, the cleaning apparatus then moves along the oblique course to a point C at which the desired course value is again modified in the opposite direction by the same angular amount as when transferring to the oblique course, so that at point C the cleaning apparatus path is oriented along a travel path II which is parallel with I. The return travel of path II is now followed and, when there is contact with the other end wall by one of sensors 11, 12, the return travel takes place for a short interval similar to A-B, followed by a short oblique distance and subsequent transfer to the next travel path. By the appropriate choice of angle A and the appropriate choice of the time of travel along the oblique path, it is possible to establish the distance between the two traveled paths I, II without regard to the size of the swimming pool which is to be traversed and cleaned. Appropriately, the distance between the centers of paths I, II is established in such a way that the paths overlap by a certain amount which can be, for example, 20 to 40% of the cleaning apparatus width. This ensures that the entire bottom surface will be traveled over by the cleaning apparatus, even if there are divergences or variations in the geomagnetic field in the vicinity of the pool. However, the traversal of the complete bottom surface is more particularly ensured as a result of the fact that, during the entire travel, the course of the cleaning apparatus is regulated along each individual travel path.

Figure 3:
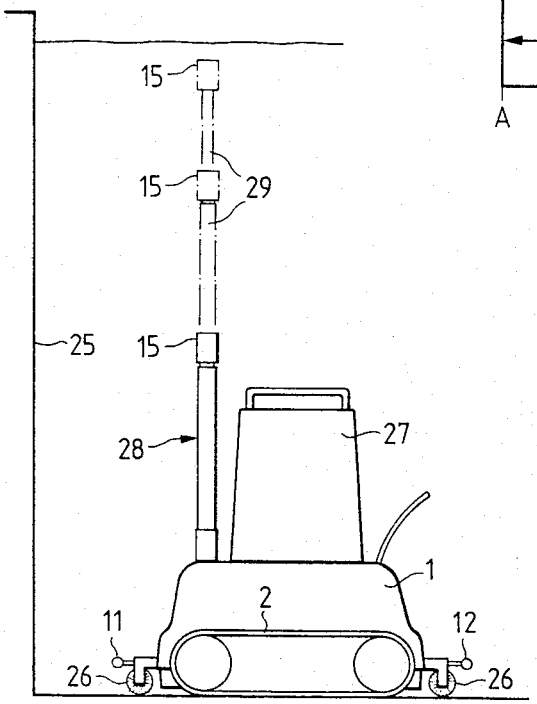
FIG. 3 is a schematic side elevation of a cleaning apparatus in accordance with the invention having a vertically adjustable compass.

FIG. 3 shows a side view of a suitable cleaning apparatus which includes caterpillar propelling gear with caterpillar track 2 being visible. At both end faces of chassis 1 are rotary cleaning rollers or brushes 26 in front of which are positioned sensors 11, 12. The operating portions of the cleaning apparatus, including the filter or the like, are surrounded by a casing 27. A support 28 carrying the compass 15 is supported on housing 1. Support 28 can advantageously be constructed as a telescopic mast enabling the compass 15 to be vertically adjustable. This provides the further possibility of escaping disturbances to the ambient geomagnetic field which might be caused by reinforcement such as steel rods extending through the pool, particularly in the pool bottom.

It will be recognized that the track-laying propelling means can be replaced, if desired, by wheels which can be controlled by appropriate steering mechanisms.

While certain advantageous embodiments have been chosen to illustrate the invention, it will be understood by those skilled in the art that various changes and modifications can be made therein without departing from the scope of the invention as defined in the appended claims.

What is claimed is:

1. A method of controlling an underwater cleaning apparatus for cleaning the interior of a water tank, the cleaning apparatus being of the type including a housing carrying cleaning means and reversible and steerable means for propelling the housing across a tank surface, comprising the steps of:

establishing a sequence of courses defining a path of travel for the apparatus to follow repeatedly traverse the surface such that all of the surface will be traversed and cleaned in a systematic fashion, initially setting the apparatus on a first course, producing a signal representatative of the actual course being traveled by the cleaning apparatus by actual travel sensor means carried by said housing, comparing the first course with the actual course signal and adjusting the steerable means to correct deviations, detecting an obstacle in the path of the apparatus and causing reversal of its direction of travel by limit sensors carried by said housing, after detecting the obstacle, setting the apparatus on a second course at a predetermined angle relative to the first course and holding the second course for a first predetermined period of time, and after traveling along the second course for the first predetermined time period, directing the apparatus along a third course parallel with the first course.

2. A method according to claim 1 wherein the method includes, before setting the apparatus on the second course, propelling the apparatus along the first course, but in a reversed direction, for a second predetermined period of time.

3. A method according to claim 1 wherein transitions between the first and second courses are accomplished with the apparatus stationary.

4. An underwater cleaning apparatus for traversing a surface of a tank or the like for cleaning the surface, comprising:

a housing carrying cleaning means;

reversible and steerable drive means for propelling said housing across the track surface, said drive means including caterpillar track means for conveying said housing, a drive motor and clutch means for selectively coupling said drive motor to said track means;

actual travel sensor means for producing a signal representative of the actual course being traveled by the apparatus;

setting means for producing signals representative of desired courses to be followed including a first course, a second timed course at a predetermined angle relative to the first course after detection of an obstacle and a third course parallel to the first course after completion of the second course;

timer means operatively associated with said setting means for determining the lengths of time for each course;

limit sensor means, carried by said housing, for detecting an obstacle in the path of the apparatus and for reversing said drive means upon detecting an obstacle;

means for comparing the actual and desired course signals and for producing an error signal; and control means responsive to said error signals for controlling said clutch means to thereby steer said apparatus along each course.

5. An apparatus according to claim 4 wherein a support mounts said actual travel sensor means on and in spaced relationship from said housing.

6. An apparatus according to claim 5 wherein said support comprises a vertically adjustable member for elevating said actual travel sensor means away from said housing.

7. An apparatus according to claim 6 wherein said support comprises a telescoping mast.

* * * * *